United States Patent [19]

Ball

[11] 3,989,341

[45] Nov. 2, 1976

[54] ELECTRIC CONNECTOR APPARATUS AND METHOD

[75] Inventor: Robert D. Ball, Tucker, Ga.

[73] Assignee: Kearney-National, Inc., Atlanta, Ga.

[22] Filed: Oct. 6, 1975

[21] Appl. No.: 619,957

Related U.S. Application Data

[63] Continuation of Ser. No. 512,942, Oct. 7, 1974, abandoned.

[52] U.S. Cl. ..... 339/111; 339/255 R

[51] Int. Cl.[2] ..... H01R 13/52

[58] Field of Search ..... 339/111, 255

[56] References Cited

UNITED STATES PATENTS

| | | | |
|---|---|---|---|
| 2,014,056 | 9/1935 | Van Noorden | 339/255 L |
| 3,384,861 | 5/1968 | Phillips | 339/111 |
| 3,539,972 | 11/1970 | Ruete et al. | 339/111 |
| 3,542,986 | 11/1970 | Kotski | 200/149 |

*Primary Examiner*—W. Tupman
*Assistant Examiner*—Neil Abrams
*Attorney, Agent, or Firm*—Walter M. Rodgers

[57] ABSTRACT

An electric terminal bushing having a hollow tubular contact engageable with the contact pin of an electric elbow type connector is arranged so as substantially to reduce the arcing time during a switch closing operation and includes means for slidably mounting the hollow tubular contact within the bushing between normal and interim positions, and spring means arranged to move said contact toward its normal position following movement of said contact toward its interim position during a circuit closing operation.

5 Claims, 4 Drawing Figures

ELECTRIC CONNECTOR APPARATUS AND METHOD

This is a continuation of application Ser. No. 512,942 filed Oct. 7, 1974 now abandoned.

Gas generated by an electric arc within the bushing structure of an electric terminal bushing may be very harmful because the pressure built up during high current fault conditions may be sufficient to damage severely or even destroy the bushing. Furthermore if an operator imparts a low velocity closing movement to the movable connector, the time elapsed while the arc exists may be sufficient to damage severely the conducting elements of the contact structure and a substantial quantity of gas may be produced which may tend to impede the closing operation and may also damage the bushing. Furthermore bushings which have been called upon to perform a substantial number of switch opening and closing operations may accumulate carbon deposits which effectively increase the distance between the contacts at which an arc initially strikes. Under these conditions arcing time is prolonged and the attendant production of gas is increased.

One approach to reducing arcing time and the attendant production of an undesired large volume of gas has caused such arc produced gases to operate a piston in such a manner as to accelerate contact closing movement so as to reduce the closing time thereby to limit the duration of the arc and the attendant production of a large volume of gas. This procedure in a sense is self defeating because the gas which is relied upon to effect prompt closing of the contacts also inherently tends to impede the closing operation to a degree and for this reason is objectionable.

According to this invention, the duration of an electric arc during switch closing operations is substantially reduced by the provision of energy storage means energized in coordination with movement in one direction toward an interim position of a contact movably mounted on support structure within an electric bushing and arranged so as to impart switch closing sliding movement to the contact from its interim position toward a cooperating contact pin thereby to effect a rapid and efficient switch closing operation.

For a better understanding of the invention, reference may be had to the following detailed description taken in conjunction with the accompanying drawings in which.

Figure 2:
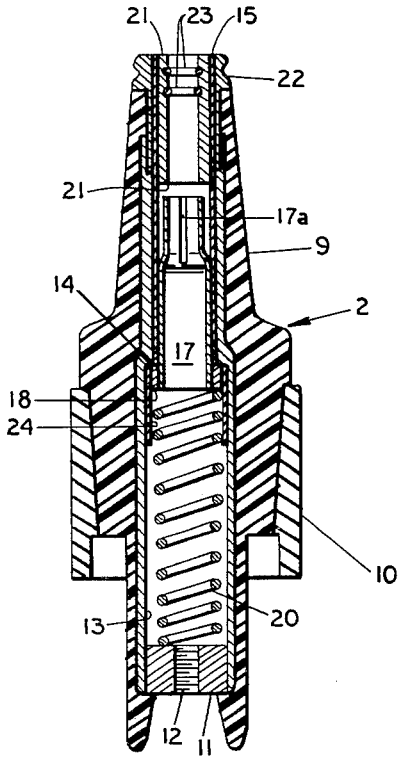
FIG. 2 is a view similar to FIG. 1 but shows the parts in the positions they occupy during the initial stages of a switch closing operation but with the connector housing omitted.
Figure 2:
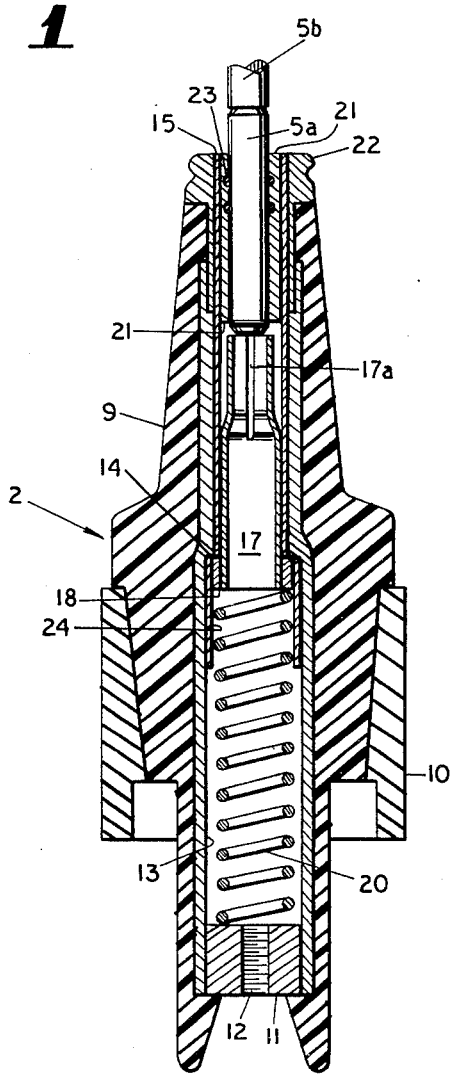
Figure 3:
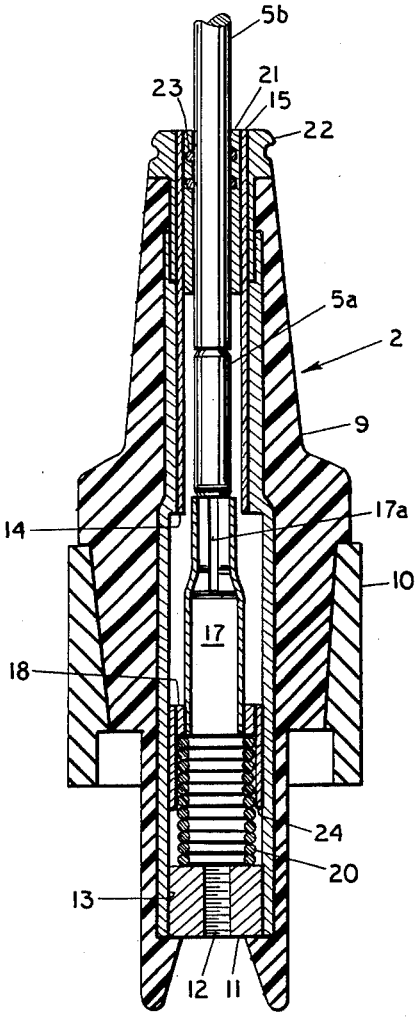
Figure 4:
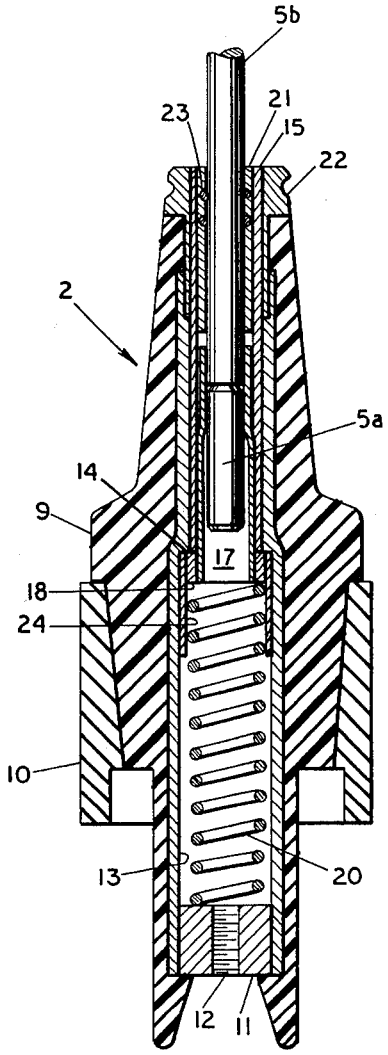

FIG. 3 is a view similar to FIG. 2 but shows the parts in the positions which they occupy at the instant when a slidably mounted contact within the bushing occupies an interim position in which energy storage means in the form of compression spring means is fully energized; and in which FIG. 4 depicts the parts in the positions which they occupy immediately following movement of the bushing contact toward the connector contact pin to complete a contact closing operation.

With reference to the drawings, the numeral 1 generally designates an elbow type connector arranged to cooperate with a bushing terminal generally designated by the numeral 2. As is well known, the bushing 2 constitutes an exterior terminal for electric apparatus such as a transformer (not shown).

Electric connector 1 is of conventional construction and comprises housing structure 3 to which is affixed a loop 4 and within which is disposed a contact pin 5 having an end portion 5*a* constructed of insulating material and a conducting portion 5*b*. Housing 3 ordinarily includes an insulating structure 6 together with a semi-conductive structure 7. Preferably housing structures 6 and 7 are formed of elastomeric material. Insulated conductor 8 is connected with contact pin 5 within housing 3.

Terminal bushing 2 comprises a support structure in the form of elastomeric sleeve 9 formed of insulating material together with elastomeric material 10 formed of semi-conducting material in known manner. Disposed within the housing structure 9,10 is a conducting element 11 having an internally threaded aperture 12 for receiving an externally threaded conducting element (not shown) but which may form a part of a transformer winding, for example. A conducting sleeve 13 is secured to and envelops the electric conductor 11 and extends upwardly toward the upper end of the bushing 2. Sleeve 13 constitutes part of the support structure and is provided with a shoulder 14 which is flush with the lower end of a cylindrical insulating sleeve 15. Sleeve 15 preferably is formed of mechanically strong plastic material and the sleeve is fixed in position relative to the housing 9 of elastomeric material and to the sleeve 13.

According to this invention the hollow contact 17 having its upper end slotted as shown at 17*a*, is slidably mounted within sleeve 13 and is provided with an outwardly projecting integral shoulder 18 which engages the inwardly projecting shoulder 14 formed in the fixed sleeve 13 to determine the normal switch closed or open position of contact 17. Energy storage means in the form of compression spring 20 biases contact 17 toward its normal position as shown in FIG. 1.

For the purpose of aiding in the extinguishment of electric arcs drawn between the contact 5*b* and the tubular hollow contact 17, a quench tube 21 is fixedly mounted within the upper end of plastic tube 15 about which plastic tube 22 is secured. Quench tube 21 preferably incorporates a pair of O-rings 23 disposed about the inner surface of the hollow quench tube 21 and disposed in internal grooves formed within the quench tube. Quench tube 21 is formed of arc extinguishing material and is securely affixed within the upper end of plastic tube 15.

For diverting electric current around spring 20, a sleeve contact 24 is secured about the flange which forms shoulder 18 and forms sliding contact with the inner surface of the lower larger portion of sleeve 13.

Figure 1:
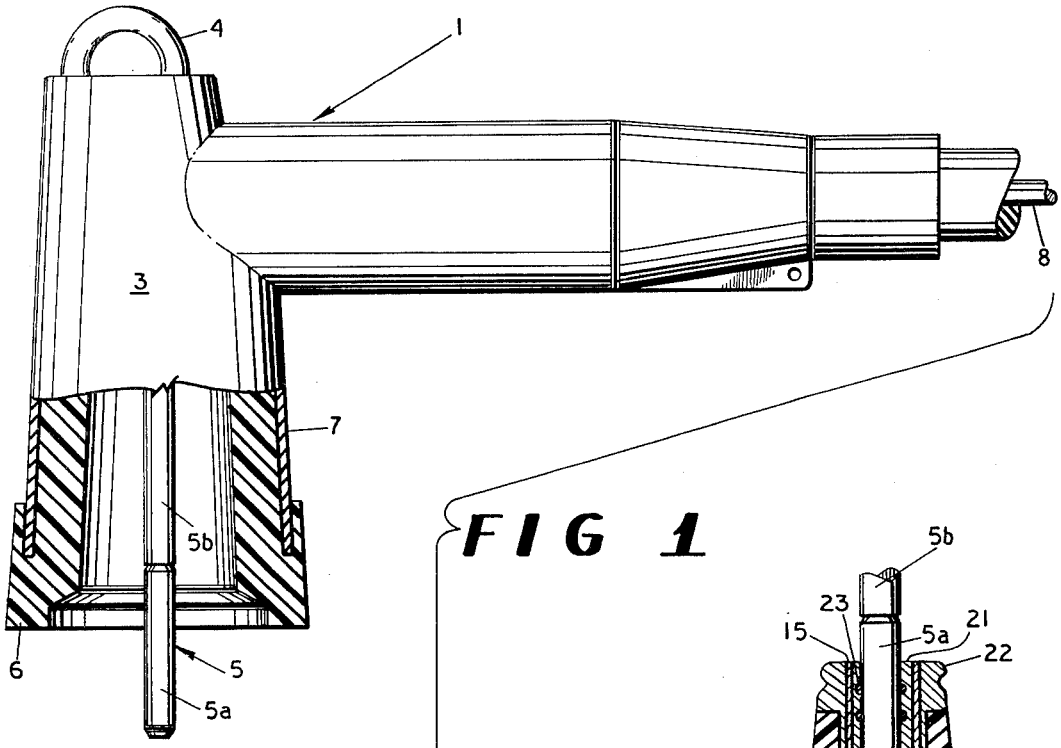
FIG. 1 is a view of a terminal bushing shown in cross-section and of an associated elbow type connector shown partially in section and spaced from the bushing to show an open circuit condition.

In order to effect a contact closing operation, the connector 1 is lowered from the position shown for example in FIG. 1 toward the bushing 2. An initial stage of closing is depicted in FIG. 2. The position represented in FIG. 2 is such that the lower end of insulating portion 5*a* of the contact pin 5 is in frictional engagement with the upper end of hollow contact 17 which is shown in its normal position.

A subsequent stage in a closing operation is shown in FIG. 3. In FIG. 3, the contact 17 is shown in its interim position in which spring 20 is fully compressed. The lower tip of insulating portion 5*a* of the contact pin 5 is in frictional contact with the upper end of contact 17. Continued downward movement of contact pin 5 and upward pressure by spring 20 eventually overcomes the contact friction between contact sleeve 17 and portion 5*a* of contact pin 5 and contact 17 is moved upwardly by spring 20.

FIG. 4 depicts the contact 17 in its upper or normal position due to the action of spring means 20, the upper limit of travel being determined by engagement of shoulder 18 on the contact 17 with the shoulder 14 forming a part of metallic sleeve 13. This movement drives the contact 17 into enveloping relationship with respect to the lower end of the conducting part 5*b* of the contact pin 5, the lower portion of the contact pin 5, designated 5*a*, being disposed within the tubular contact 17. In this condition the contacts 5*b* and 17 are fully closed and any arc drawn is extinguished.

Thus by the invention, it is apparent that the quick upward travel of the contact 17 from its interim position shown in FIG. 3 to its upper or normal position represented in FIG. 4 substantially reduces the duration of the arc and in turn substantially limits the formation of gas within the support structure comprising the bushing 2. By this means internal pressures are limited and effectively controlled and damage to the bushing 2 substantially minimized or eliminated. Furthermore since the arcing time is substantially reduced, the deleterious effects of arcing between the contacts 5*b* and 17 are minimized.

FIG. 4 shows the contacts 5*b* and 17 fully closed. In order to separate the contacts, the elbow connector 1 is simple elevated and the frictional relationship between contact pin 5 and hollow contact 17 is overcome. Toward this end a hook stick or other suitable manipulative apparatus is engaged with the operating hook 4 and an upward force exerted thereon. Continued upward movement of elbow connector 1 results in a complete separation of elbow 1 and bushing 2 to cause the parts to occupy open circuit positions analogous to those represented in FIG. 1. During opening, contact 17 remains in its normal position as shown in FIG. 4 and spring 20 is expanded as shown in that figure.

The embodiments of the invention in which an exclusive property or privilege is claimed are defined as follows:

1. Electric connector apparatus comprising support structure including an elongated conducting sleeve having an inwardly projecting shoulder intermediate its ends, an elongated tubular hollow unitary electric contact slidably mounted within said sleeve and having an outwardly projecting flange defining an integral shoulder engageable with said inwardly projecting shoulder of said sleeve to determine a normal position of said contact relative to said sleeve, said unitary contact being movable longitudinally from its normal position to an interim position due to frictional engagement with a cooperating contact during insertion of the cooperating contact into one end of said hollow unitary contact to initiate but not complete a circuit closing operation and without establishing an arc therebetween, spring means arranged to react between a part of said support structure and said unitary contact and energized by movement of said unitary contact toward its interim position for moving said unitary contact longitudinally to its normal position to complete a circuit closing operation when the force exerted by said spring means exceeds the frictional force between said unitary contact and the cooperating contact, and a sleeve contact disposed about said flange and secured thereto and in sliding contact with the part of the inner surface of said conducting sleeve which is adjacent said spring means to form a shunt circuit for diverting a substantial portion of current around said spring.

2. Apparatus according to claim 1 wherein said support structure comprises an electric bushing and the cooperating contact comprises a contact pin of an elbow type connector.

3. Electric apparatus according to claim 1 wherein said unitary contact and the cooperating contact move longitudinally in substantial unison during movement of said unitary contact from its normal to its interim position and wherein said unitary contact moves slidably relative to the cooperating contact during movement of said unitary contact to its normal position.

4. Electric connector apparatus comprising elongated support structure having an inwardly projecting shoulder intermediate its ends, a hollow unitary electric contact having an outwardly projecting shoulder and mounted on said support structure and movable longitudinally relative thereto between a normal position determined by engagement between said shoulders and an interim position, an elongated contact pin having an end portion constructed of insulating material secured to and forming a continuation of a conducting portion thereof, the end portion of said contact pin being engageable within an end of said hollow unitary contact to move said hollow contact longitudinally from its normal position to its interim position before completion of an electric circuit between said contact pin and said unitary contact due to frictional engagement therebetween, and contact operating means comprising spring means urging said hollow contact to said normal position and energized in coordination with movement of said hollow contact from its normal position toward its interim position for quickly moving said contact toward its normal position and into contact making engagement with said conducting portion of said contact pin in an interval of time which is sufficiently short in duration as substantially to reduce the deleterious effect of the arc when the operating force of said contact operating means exceeds the frictional force between said hollow contact and said end portion of said contact pin which is formed of insulating material.

5. Apparatus according to claim 4 wherein said contact operating means is arranged to react between said support structure and said hollow contact.

* * * * *